United States Patent [19]

Cady

[11] 4,007,653

[45] Feb. 15, 1977

[54] PUNCHING DEVICE WITH PUNCH RETAINER

[75] Inventor: Percy L. Cady, Darien Center, N.Y.

[73] Assignee: Houdaille Industries, Inc., Buffalo, N.Y.

[22] Filed: July 7, 1975

[21] Appl. No.: 593,783

[52] U.S. Cl. ..... 83/140; 83/684; 83/698

[51] Int. Cl.[2] ..... B26F 1/14

[58] Field of Search ..... 83/140, 637, 698, 136, 83/684

[56] References Cited

UNITED STATES PATENTS

| | | | |
|---|---|---|---|
| 2,245,676 | 6/1941 | Johnson | 83/698 X |
| 3,267,975 | 8/1966 | Enders | 83/698 X |
| 3,368,436 | 2/1968 | Weisbeck | 83/522 X |

*Primary Examiner*—Willie G. Abercrombie
*Attorney, Agent, or Firm*—Hill, Gross, Simpson, Van Santen, Steadman, Chiara & Simpson

[57] ABSTRACT

A punching device includes a fixed frame adapted to support punch means in alignment with a ram. An assembly of the punch, a guide and stripping sleeve and a stripping spring is removable as a unit and such assembly includes means by which such assembly is retained together, especially during handling away from the frame of the punching device. To this end, the punch has a radial opening, such as a circumferential groove, in which there is disposed a friction member, such as of plastic, which has an interference fit with the interior of the stripping sleeve.

5 Claims, 3 Drawing Figures

Fig. 1
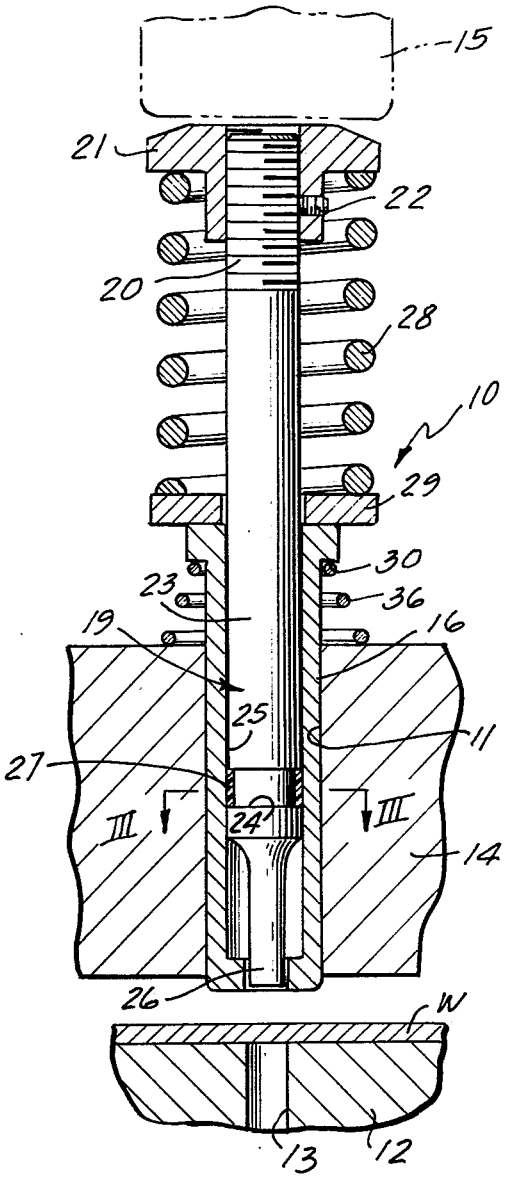
Fig. 2
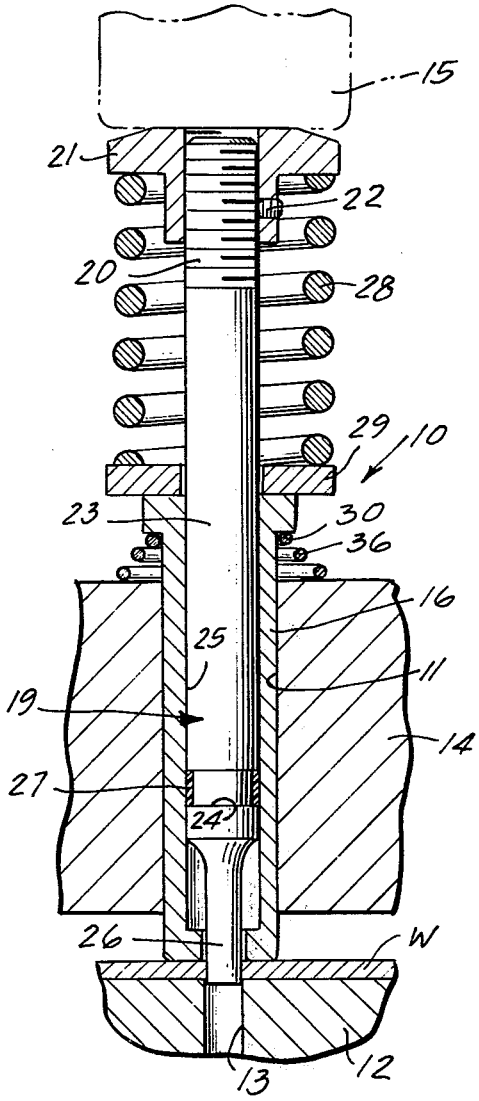
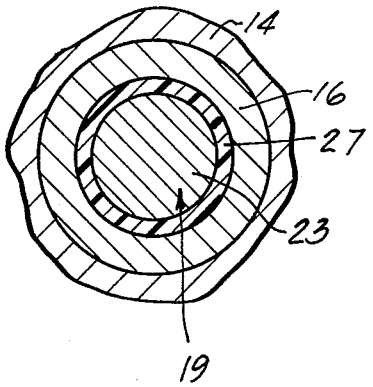
Fig. 3

PUNCHING DEVICE WITH PUNCH RETAINER

BACKGROUND OF THE INVENTION

1. Field of the Invention

This invention relates to a punching device for use in a punch press, press brake or the like.

2. Prior Art

Various types of frames or tool supports form a part of a punch press frame or are mounted thereon so that the tooling is in alignment with the ram of the press or so that it can be moved into alignment with the ram of the press. Such tooling is preferably removable manually without interference by any type of holding means, when the same is remote from the ram. One example of such a frame, showing further background of this invention, is shown in U.S. Pat. No. 3,270,605. In such a device, the upper arm of the frame is mounted to swing away from the punching axis, thereby bringing the tooling into a position where the same can be manually grasped and slid out of the frame for replacement. The tooling so removed includes a punch guide and stripper sleeve, a punch, and a stripping spring. With these components detached from the press, they can become disassembled with respect to each other. However, to utilize such tooling to full advantage, it is necessary that all components of the assembly stay together during such changing process. Prior hereto, it has been known to use a set screw to keep the guide sleeve loosely attached to the punch. Doing so required the provision of a collar as part of the guide sleeve to provide sufficient material which was tapped to accommodate the set screw.

SUMMARY OF THE INVENTION

According to the present invention, a punching device is provided wherein the punch body has a radially opening recess directed toward the interior of the sleeve, there being a friction member disposed in such recess, and having a frictional fit with the interior of the sleeve. With this arrangement, normal punching operations, assembly and disassembly are not interfered with, and yet the forces holding the assembly together are readily overcome if necessary for disassembly, such as for sharpening the punch.

Accordingly, it is an object of the present invention to provide a punching device wherein the punch guide and stripper assembly has means by which its components are retained together for separate handling as a unit in connection with tooling changes.

Another object of the present invention is to provide a retainer which can be snapped onto a punch, without interfering with normal operation.

A further object of the present invention is to provide means by which a punch guide and stripping sleeve assembly is held together in a simple and inexpensive manner.

Many other advantages, features and additional objects of the present invention will become manifest to those versed in the art upon making reference to the detailed description and the accompanying sheet of drawings in which a preferred structural embodiment incorporating the principles of the present invention is shown by way of illustrative example.

ON THE DRAWING

FIG. 1 is a fragmentary cross-sectional view of a punching device in accordance with the present invention, shown just prior to the start of a working stroke;

FIG. 2 corresponds to FIG. 1, shown at the end of a working stroke; and

FIG. 3 is a cross-sectional view taken along line III—III of FIG 1.

AS SHOWN ON THE DRAWING

The principles of the present invention are particularly useful when embodied in a punch device such as shown fragmentarily in FIG. 1, generally indicated by the numeral 10. The punching device includes a frame that has a lower arm or portion 12 which has a die aperture 13 over which a workpiece W is disposed. The frame includes an upper arm 14 which could be the upper arm of a C-frame, and which typically is a swing-arm as shown and described in the patent cited above, by which the tooling is disposed in registration with a ram 15. Any tendency for the tooling to jump out of the upper arm during stripping is precluded by the presence of the ram 15, and therefore no structure needs to be provided for holding the assembly together during operation. However, during handling of the tooling remotely from the upper arm 14, retention means in accordance with the present invention is preferred.

The upper arm 14 has a bore 11 in which there is slidably disposed a punch and stripper assembly which can be lifted out as a unit from the upper arm 14. The punch and stripper assembly includes a punch guide and stripper sleeve 16. The punch and stripper assembly further includes a punch 19, here shown to be of the two-piece type and to that end it includes a set of screw threads 20 at its upper end on which a punch head 21 is adjustably positioned and locked by a set screw 22. The punch 19 has a central body portion 23 which is provided with a radially opening recess 24, the recess 24 here being shown as an annular groove. The punch 19 has a cutting end 26 of a reduced diameter for coacting with the die aperture 13 on the workpiece W. A friction member 27 is disposed in the body recess 24, and comprises plastic material of such size as to have a frictional fit with the interior wall 25 of the sleeve 16. The friction is provided by sizing the friction member 27 so that in its free form, it has a size greater than the interior wall 25 of the sleeve 16, thus producing an interference fit. However, the friction member 27 comprises plastic material that yields to the extent necessary to be received in the sleeve 16 with a friction greater than that which is inherent between the punch 19 and the sleeve 16. Preferably, the radial depth of the recess 24 is no greater than the radial depth of the screw threads 20. Thus in the embodiment shown, the minimum cross-sectional area of the punch body at the recess 24 is no smaller than the minimum cross-sectional area of the punch body 23 at the screw threads 20. The friction member 27 is formed as a cylindrical sleeve which has sufficient resiliency so as to enable the member 27 to be snapped onto the punch 19 in its recess 24.

Also included in the punch and stripper assembly is a stripping spring 28 acting between the punch head 21 and the upper end of the sleeve 16, here through an annular washer 29. On expansion, the spring 28 urges the lower or cutting end 26 of the punch 19 into the stripping sleeve 16. A lifting spring 36 acts between the upper surface of the upper arm 14 and the punch and stripping assembly, here directly against a downwardly facing shoulder 30 on the stripping sleeve 16. The effective size of the head that provides the shoulder 30 is increased by the washer 29, so that in a sense it is in effect a part of the sleeve 16 functionally.

With this arrangement, the sleeve 16, and hence the punch and guide assembly, is slidably removable from the bore 11 as a unit for replacement. When removed, the friction member or retainer 27 holds the removed parts together as an assembly for joint handling in connection with rapid manual tool changes.

When the punch and stripper assembly needs to be disassembled and reassembled, such as for sharpening of the punch, the retainer 27 is left in position on the punch 19. Manual tugging will readily enable removal of the punch.

After assembly and during use as shown on the drawings, the retainer 27 does not in any way interfere with normal punching operation of the device, the stripping spring 28 having far more force for stripping purposes than needed to overcome the friction of the retainer 27.

The device shown on the drawings needs no angular orientation for assembly and can be assembled or disassembled only by relative axial movement.

The plastic material of which the friction member 27 is made typically comprises Nylon or Polyamide.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A punching device comprising:

a. a frame having a lower arm on which a die is supported, and an upper arm having a vertical bore aligned therewith;

b. a punch guide and stripper sleeve slidably disposed in the bore in said upper arm;

c. a punch having a body slidably diposed in said sleeve, said body having a radially opening recess therein directed toward the interior of said sleeve;

d. a stripping spring acting between said sleeve and said punch to urge the lower end of said punch into said sleeve;

e. a friction member, carried by said body, disposed in said body recess and having a sliding frictional fit with the interior wall of said sleeve greater than that which the punch body inherently has; and f. a lifting spring acting between said sleeve and said upper arm and urging said sleeve away from said die.

2. A punching device according to claim 1 in which said recess is an annular groove.

3. A punching device according to claim 1 in which said friction member comprises a yieldable plastic material that has an interference fit with said sleeve, as related to the free form of the friction member.

4. A punching device according to claim 1 in which said punch includes a set of screw threads on the upper end of said body portion, and a head adjustably carried thereon against which said stripping spring acts, the radial depth of said recess being no greater than the radial depth of said screw threads.

5. A punching device according to claim 2 in which said frictional member is a cylindrical sleeve.

* * * * *